US006692367B1

(12) United States Patent
Duran

(10) Patent No.: US 6,692,367 B1
(45) Date of Patent: Feb. 17, 2004

(54) BASEBALL PRACTICE FACILITY

(76) Inventor: Christian Duran, 4900 N. Grand Ave., #126, Covina, CA (US) 91724

( * ) Notice: Subject to any disclaimer, the term of this patent is extended or adjusted under 35 U.S.C. 154(b) by 0 days.

(21) Appl. No.: 10/314,078

(22) Filed: Dec. 6, 2002

(51) Int. Cl.[7] ..... A63C 19/06

(52) U.S. Cl. ..... 472/92; 473/421; 473/422; 473/451

(58) Field of Search ..... 473/421, 422, 473/451, 457; 472/92, 94

(56) References Cited

U.S. PATENT DOCUMENTS 3,487,595 A * 1/1970 Schumann ..... 52/8
3,948,512 A * 4/1976 Worthington ..... 473/459
4,941,662 A 7/1990 De Perna
5,639,084 A * 6/1997 Kawasaki ..... 473/421
5,738,588 A 4/1998 Esser
5,906,553 A 5/1999 Carroccio

* cited by examiner

*Primary Examiner*—Kien T. Nguyen

(57) ABSTRACT

A baseball practice facility for practicing individual skills in baseball. The baseball practice facility includes a plurality of station areas being designed for receiving users to practice individual skills in baseball. A plurality of walkways are positioned around each of the station areas. The walkways are designed for permitting the users to walk between the station areas. A plurality of ball delivery assemblies are selectively positioned in the station areas. Each of the ball delivery assemblies is designed for launching a ball at one of the users for testing a particular skill of the associated one of the users.

20 Claims, 1 Drawing Sheet

BASEBALL PRACTICE FACILITY

BACKGROUND OF THE INVENTION

1. Field of the Invention

The present invention relates to practice facilities and more. particularly pertains to a new baseball practice facility for practicing individual skills in baseball.

2. Description of the Prior Art

The use of practice facilities is known in the prior art. U.S. Pat. No. 5,906,553 describes a system for allowing a plurality of users to practice batting. Another type of practice facility is U.S. Pat. No. 4,941,662 having a plurality of ball sensing zones for determining the direction and the play determined when the ball is hit through one of the ball sensing zones. U.S. Pat. No. 5,738,588 has a playing filed boundary that is that is temporary to allow the boundary to be taken down when not in use.

While these devices fulfill their respective, particular objectives and requirements, the need remains for a system that has certain improved features that allow a user to practice specific individual skills used in baseball.

SUMMARY OF THE INVENTION

The present invention meets the needs presented above by providing a plurality of station areas that each allow the user to practice a different individual skill.

Still yet another object of the present invention is to provide a new baseball practice facility that provides seating for observers to use to watch those using the station areas.

To this end, the present invention generally comprises a plurality of station areas being designed for receiving users to practice individual skills in baseball. A plurality of walkways are positioned around each of the station areas. The walkways are designed for permitting the users to walk between the station areas. A plurality of ball delivery assemblies are selectively positioned in the station areas. Each of the ball delivery assemblies is designed for launching a ball at one of the users for testing a particular skill of the associated one of the users.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
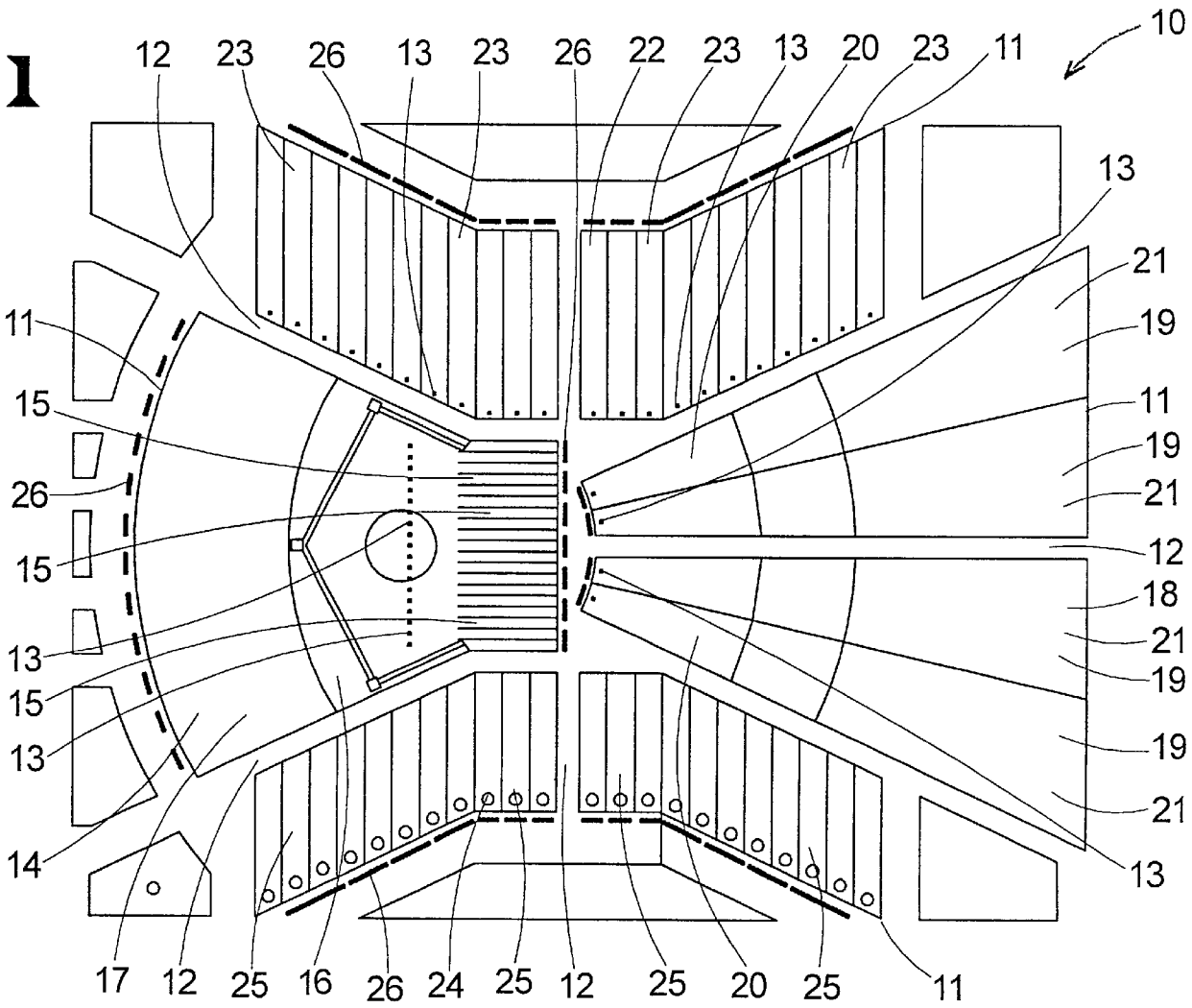
FIG. 1 is a top view of a new baseball practice facility according to the present invention.

With reference now to the drawings, and in particular to FIG. 1 thereof, a new baseball practice facility embodying the principles and concepts of the present invention and generally designated by the reference numeral 10 will be described.

As best illustrated in FIG. 1, the baseball practice facility 10 generally comprises a plurality of station areas 11 being designed for receiving users to practice individual skills in baseball.

A plurality of walkways 12 are positioned around each of the station areas 11. The walkways 12 are designed for permitting the users to walk between the station areas 11.

A plurality of ball delivery assemblies 13 are selectively positioned in the station areas 11. Each of the ball delivery assemblies 13 is designed for launching a ball at one of the users for testing a particular skill of the associated one of the users.

The station areas 11 comprise a batting area 14. A portion of the ball delivery assemblies 13 are positioned in the batting area 14. The batting area 14 is designed for receiving users to practicing hitting the ball.

The batting area 14 comprises a plurality of batting sections 15. Each of the batting sections 15 is aligned with one of the ball delivery assemblies 13 whereby the associated one of the ball delivery assemblies 13 is designed for pitching a ball along a length of the associated one of the batting sections 15. Each of the batting sections 15 is designed for receiving one of the users whereby the batting sections 15 are for permitting the associated one of the users to practice hitting a ball with a bat when the associated one of the ball delivery assemblies 13 pitches the ball at the users.

The batting area 14 comprises an infield section 16 and an outfield section 17. The infield section 16 is positioned adjacent the batting sections 15 of the batting area 14. The outfield section 17 is positioned adjacent the infield section 16 of the batting area 14 whereby the infield section 16 is positioned between the batting sections 15 and the outfield section 17. The infield section 16 and outfield section 17 are designed for allowing users to judge how far the ball was hit and the placement of the ball when the users hit the ball pitched by the associated one of the ball delivery assemblies 13.

The station areas 11 comprise an outfield area 18. A portion of the ball delivery assemblies 13 are positioned in the outfield area 18 whereby each of the ball delivery assemblies 13 is designed for throwing a ball along a portion of the of the length of the outfield area 18. The outfield area 18 is designed for receiving the users wishing to practice fielding the ball as in an outfield of an baseball field when each of the ball delivery assemblies 13 launches the ball.

The outfield area 18 comprises a plurality of outfield tracks 19. One of the ball delivery assemblies 13 is positioned in each of the outfield tracks 19 whereby that associated one of the ball assemblies is designed for launching the ball along a portion of the length of the associated one of the outfield tracks 19 to be fielded by the associated one of the users positioned opposite the associated one of the ball delivery assemblies 13.

Each of the outfield tracks 19 of the outfield area 18 comprises an infield portion 20 and an outfield portion 21. The outfield portion 21 is positioned adjacent the infield portion 20. Each of the ball delivery assemblies 13 associated with the outfield area 18 is positioned in the infield portion 20 of each of the outfield tracks 19 whereby each of the ball delivery assemblies 13 launches the ball into the outfield portion 21 of the associated one of the outfield tracks 19 to be fielded by a user positioned in the outfield portion 21 of the associated one of the outfield tracks 19 of the outfield area 18.

The station areas 11 comprise an infield area 22. A portion of the ball delivery assemblies 13 are positioned in the infield area 22 whereby each of the ball delivery assemblies 13 are designed for throwing a ball along a portion of the of the width of the infield area 22. The infield area 22 is designed for receiving users wishing to practice fielding the ball as in an infield of the baseball field when each of the ball delivery assemblies 13 launches the ball.

The infield area 22 comprises a plurality of infield tracks 23. One of each of the ball delivery assemblies 13 is positioned in each of the infield tracks 23 whereby the associated one of the ball delivery assemblies 13 is designed for launching the ball along a portion of the length of the associated one of the infield tracks 23 to be fielded by the associated one of the users positioned opposite the associated one of the ball delivery assemblies 13.

The station areas 11 comprises a pitching area 24. The pitching area 24 is designed for receiving users wishing to practice pitching the ball. The pitching area 24 comprises a plurality of pitching tracks 25. Each of the pitching tracks 25 is designed for receiving one of the users whereby each of the users pitches the ball along a length of the associated one of the pitching tracks 25.

A plurality of seats 26 are positioned on the walkways 12. Each of the seats 26 is positioned proximate at least one of the station areas 11. Each of the seats 26 is designed for receiving a spectator whereby the spectator my sit and watch the users positioned in one of the station areas 11.

In use, the user enters the walkways 12 and approaches one of the station areas 11 of interest to the user. The user enters the batting portion of the batting area 14 when the user desires batting practice. Once the user is positioned in the batting section. One of the ball delivery assemblies 13 pitches a ball at the user and the user swings at the ball with the bat and watches the distance and location of the ball as it lands. The user enters the outfield area 18 when the user wishes to practice fielding techniques. The user enters the outfield portion 21 of the desired outfield track and attempts to field the ball as the ball is launched towards the user by one of the ball delivery assemblies 13. The user enters the infield area 22 when the user wishes to practice fielding balls in the infield. The user takes a position in one of the infield tracks 23 and attempts to field the ball as the ball is launched towards the user by one of the ball delivery assemblies 13. The user enters the pitching area 24 when the user wishes to practice pitching the ball. The user enters one of the pitching tracks 25 and practices pitching the ball along a length of the associated one of the pitching tracks 25.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A baseball practice facility for practicing individual skills of baseball, the baseball practice facility comprising:

a plurality of station areas being adapted for receiving users to practice individual skills in baseball;

a plurality of walkways being positioned around each of said station areas, said walkways being adapted for permitting the users to walk between said station areas; an a plurality of ball delivery assemblies being selectively positioned in said station areas, each of said ball delivery assemblies being adapted for launching a ball at one of the users for testing a particular skill of the associated one of the users; and said station areas comprising an infield area, a portion of said ball delivery assemblies being positioned in said infield area such that each of said ball delivery assemblies is adapted for throwing a ball along a portion of the of the width of the infield area, said infield area being adapted for receiving users wishing to practice fielding the ball as in an infield of the baseball field when each of said ball delivery assemblies launches the ball.

2. The baseball practice facility as set forth in claim 1, further comprising:

said station areas comprising a batting area, a portion of said ball delivery assemblies being positioned in said batting area, said batting area being adapted for receiving users to practicing hitting the ball.

3. The baseball practice facility as set forth in claim 2, further comprising:

said batting area comprising a plurality of batting sections, each of said batting sections being aligned with one of said ball delivery assemblies such that the associated one of said ball delivery assemblies is adapted for pitching a ball along a length of the associated one of said batting sections, each of said batting sections being adapted for receiving one of the users such that said batting sections are for permitting the associated one of the users to practice hitting a ball with a bat when the associated one of said ball delivery assemblies pitches the ball at the users.

4. The baseball practice facility as set forth in claim 3, further comprising:

said batting area comprising an infield section and an outfield section, said infield section being positioned adjacent said batting sections of said batting area, said outfield section being positioned adjacent said infield section of said batting area such that said infield section is positioned between said batting sections and said outfield section, said infield section and outfield section being adapted for allowing users to judge how far the ball was hit and the placement of the ball when the users hit the ball pitched by the associated one of said ball delivery assemblies.

5. The baseball practice facility as set forth in claim 1, further comprising:

said station areas comprising an outfield area, a portion of said ball delivery assemblies being positioned in said outfield area such that each of said ball delivery assemblies is adapted for throwing a ball along a portion of the of the length of the outfield area, said outfield area being adapted for receiving the users wishing to practice fielding the ball as in an outfield of an baseball field when each of said ball delivery assemblies launches the ball.

6. The baseball practice facility as set forth in claim 5, further comprising:

said outfield area comprising a plurality of outfield tracks, one of said ball delivery assemblies being positioned in each of said outfield tracks such that that associated one of said ball assemblies is adapted for launching the ball along a portion of the length of the associated one of said outfield tracks to be fielded by the associated one of the users positioned opposite the associated one of said ball delivery assemblies.

7. The baseball practice facility as set forth in claim 6, further comprising:

each of said outfield tracks of said outfield area comprising an infield portion and an outfield portion, said outfield portion being positioned adjacent said infield portion, each of said ball delivery assemblies associated with said outfield area being positioned in said infield portion of each of said outfield tracks such that each of said ball delivery assemblies launches the ball into the outfield portion of the associated one of said outfield tracks to be fielded by a user positioned in said outfield portion of the associated one of said outfield tracks of said outfield area.

8. The baseball practice facility as set forth in claim 1, further comprising:

said infield area comprising a plurality of infield tracks, one of each of said ball delivery assemblies being positioned in each of said infield tracks such that the associated one of said ball delivery assemblies is adapted for launching the ball along a portion of the length of the associated one of said infield tracks to be fielded by the associated one of the users positioned opposite the associated one of said ball delivery assemblies.

9. The baseball practice facility as set forth in claim 1, further comprising:

said station areas comprising a pitching area, said pitching area being adapted for receiving users wishing to practice pitching the ball.

10. The baseball practice facility as set forth in claim 9, further comprising:

said pitching area comprising a plurality of pitching tracks, each of said pitching tracks being adapted for receiving one of the users such that each of the users pitches the ball along a length of the associated one of said pitching tracks.

11. The baseball practice facility as set forth in claim 1, further comprising:

a plurality of seats being positioned on said walkways, each of said seats being positioned proximate at least one of said station areas, each of said seats being adapted for receiving a spectator such that said spectator my sit and watch the users positioned in one of said station areas.

12. The baseball practice facility as set forth in claim 1, further comprising:

said station areas comprising a batting area, a portion of said ball delivery assemblies being positioned in said batting area, said batting area being adapted for receiving users to practicing hitting the ball;

said batting area comprising a plurality of batting sections, each of said batting sections being aligned with one of said ball delivery assemblies such that the associated one of said ball delivery assemblies is adapted for pitching a ball along a length of the associated one of said batting sections, each of said batting sections being adapted for receiving one of the users such that said batting sections are for permitting the associated one of the users to practice hitting a ball with a bat when the associated one of said ball delivery assemblies pitches the ball at the users;

said batting area comprising an infield section and an outfield section, said infield section being positioned adjacent said batting sections of said batting area, said outfield section being positioned adjacent said infield section of said batting area such that said infield section is positioned between said batting sections and said outfield section, said infield section and outfield section being adapted for allowing users to judge how far the ball was hit and the placement of the ball when the users hit the ball pitched by the associated one of said ball delivery assemblies;

said station areas comprising an outfield area, a portion of said ball delivery assemblies being positioned in said outfield area such that each of said ball delivery assemblies is adapted for throwing a ball along a portion of the of the length of the outfield area, said outfield area being adapted for receiving the users wishing to practice fielding the ball as in an outfield of an baseball field when each of said ball delivery assemblies launches the ball;

said outfield area comprising a plurality of outfield tracks, one of said ball delivery assemblies being positioned in each of said outfield tracks such that that associated one of said ball assemblies is adapted for launching the ball along a portion of the length of the associated one of said outfield tracks to be fielded by the associated one of the users positioned opposite the associated one of said ball delivery assemblies;

each of said outfield tracks of said outfield area comprising an infield portion and an outfield portion, said outfield portion being positioned adjacent said infield portion, each of said ball delivery assemblies associated with said outfield area being positioned in said infield portion of each of said outfield tracks such that each of said ball delivery assemblies launches the ball into the outfield portion of the associated one of said outfield tracks to be fielded by a user positioned in said outfield portion of the associated one of said outfield tracks of said outfield area;

said infield area comprising a plurality of infield tracks, one of each of said ball delivery assemblies being positioned in each of said infield tracks such that the associated one of said ball delivery assemblies is adapted for launching the ball along a portion of the length of the associated one of said infield tracks to be fielded by the associated one of the users positioned opposite the associated one of said ball delivery assemblies;

said station areas comprising a pitching area, said pitching area being adapted for receiving users wishing to practice pitching the ball;

said pitching area comprising a plurality of pitching tracks, each of said pitching tracks being adapted for receiving one of the users such that each of the users pitches the ball along a length of the associated one of said pitching tracks; and a plurality of seats being positioned on said walkways, each of said seats being positioned proximate at least one of said station areas, each of said seats being adapted for receiving a spectator such that said spectator my sit and watch the users positioned in one of said station areas.

13. A baseball practice facility for practicing individual skills of baseball, the baseball practice facility comprising:

a plurality of station areas being adapted for receiving users to practice individual skills in baseball;

a plurality of walkways being positioned around each of said station areas, said walkways being adapted for permitting the users to walk between said station areas;

a plurality of ball delivery assemblies being selectively positioned in said station areas, each of said ball delivery assemblies being adapted for launching a ball at one of the users for testing a particular skill of the associated one of the users; and a plurality of seats being positioned on said walkways, each of said seats being positioned proximate at least one of said station areas, each of said seats being adapted for receiving a spectator such that said spectator my sit and watch the users positioned in one of said station areas.

14. The baseball practice facility as set forth in claim 13, further comprising:

said station areas comprising a batting area, a portion of said ball delivery assemblies being positioned in said batting area, said batting area being adapted for receiving users to practicing hitting the ball.

15. The baseball practice facility as set forth in claim 14, further comprising:

said batting area comprising a plurality of batting sections, each of said batting sections being aligned with one of said ball delivery assemblies such that the associated one of said ball delivery assemblies is adapted for pitching a ball along a length of the associated one of said batting sections, each of said batting sections being adapted for receiving one of the users such that said batting sections are for permitting the associated one of the users to practice hitting a ball with a bat when the associated one of said ball delivery assemblies pitches the ball at the users.

16. The baseball practice facility as set forth in claim 15, further comprising:

said batting area comprising an infield section and an outfield section, said infield section being positioned adjacent said batting sections of said batting area, said outfield section being positioned adjacent said infield section of said batting area such that said infield section is positioned between said batting sections and said outfield section, said infield section and outfield section being adapted for allowing users to judge how far the ball was hit and the placement of the ball when the users hit the ball pitched by the associated one of said ball delivery assemblies.

17. The baseball practice facility as set forth in claim 13, further comprising:

said station areas comprising an outfield area, a portion of said ball delivery assemblies being positioned in said outfield area such that each of said ball delivery assemblies is adapted for throwing a ball along a portion of the of the length of the outfield area, said outfield area being adapted for receiving the users wishing to practice fielding the ball as in an outfield of an baseball field when each of said ball delivery assemblies launches the ball.

18. A baseball practice facility for practicing individual skills of baseball, the baseball practice facility comprising:

a plurality of station areas being adapted for receiving users to practice individual skills in baseball;

a plurality of walkways being positioned around each of said station areas, said walkways being adapted for permitting the users to walk between said station areas;

a plurality of ball delivery assemblies being selectively positioned in said station areas, each of said ball delivery assemblies being adapted for launching a ball at one of the users for testing a particular skill of the associated one of the users;

said station areas comprising an outfield area, a portion of said ball delivery assemblies being positioned in said outfield area such that each of said ball delivery assemblies is adapted for throwing a ball along a portion of the of the length of the outfield area, said outfield area being adapted for receiving the users wishing to practice fielding the ball as in an outfield of an baseball field when each of said ball delivery assemblies launches the ball; and said outfield area comprising a plurality of outfield tracks, one of said ball delivery assemblies being positioned in each of said outfield tracks such that that associated one of said ball assemblies is adapted for launching the ball along a portion of the length of the associated one of said outfield tracks to be fielded by the associated one of the users positioned opposite the associated one of said ball delivery assemblies.

19. The baseball practice facility as set forth in claim 18, further comprising:

each of said outfield tracks of said outfield area comprising an infield portion and an outfield portion, said outfield portion being positioned adjacent said infield portion, each of said ball delivery assemblies associated with said outfield area being positioned in said infield portion of each of said outfield tracks such that each of said ball delivery assemblies launches the ball into the outfield portion of the associated one of said outfield tracks to be fielded by a user positioned in said outfield portion of the associated one of said outfield tracks of said outfield area.

20. A baseball practice facility for practicing individual skills of baseball, the baseball practice facility comprising:

a plurality of station areas being adapted for receiving users to practice individual skills in baseball;

a plurality of walkways being positioned around each of said station areas, said walkways being adapted for permitting the users to walk between said station areas;

a plurality of ball delivery assemblies being selectively positioned in said station areas, each of said ball delivery assemblies being adapted for launching a ball at one of the users for testing a particular skill of the associated one of the users;

said station areas comprising a pitching area, said pitching area being adapted for receiving users wishing to practice pitching the ball; and said pitching area comprising a plurality of pitching tracks, each of said pitching tracks being adapted for receiving one of the users such that each of the users pitches the ball along a length of the associated one of said pitching tracks.

* * * * *